US005323940A

United States Patent [19]

Hart

[11] Patent Number: 5,323,940

[45] Date of Patent: Jun. 28, 1994

[54] FALL-AWAY GUN SLING ATTACHMENT

[76] Inventor: Milton M. Hart, Rte.3, Box 510, DeQueen, Ark. 71832

[21] Appl. No.: 914,989

[22] Filed: Jul. 14, 1992

[51] Int. Cl.[5] ..... F41C 23/02

[52] U.S. Cl. ..... 224/150; 224/913; 24/2.5; 42/85

[58] Field of Search ..... 224/149, 150, 202, 255, 224/257, 258, 913; 24/2.5, 270, 271; 42/85; D3/100, 101, 104; 16/114 R, 114 A, 257, 260–263; 248/324; D22/108

[56] References Cited

U.S. PATENT DOCUMENTS

| | | | |
|---|---|---|---|
| 1,355,332 | 10/1920 | Hanson | 16/114 A |
| 2,639,480 | 5/1953 | Magid | 24/2.5 |
| 2,723,430 | 11/1955 | Paillard | 248/324 |
| 2,828,058 | 3/1958 | Arpin | 224/913 |
| 2,885,812 | 5/1959 | Arpin | 224/913 |
| 2,915,233 | 12/1959 | Mooman | 224/913 |
| 3,182,871 | 5/1965 | Gossler | 224/913 |
| 3,606,109 | 9/1971 | Brokus | 224/913 |
| 4,296,534 | 10/1981 | Nagano | 24/270 |
| 4,555,051 | 11/1985 | Johnson | 224/913 |
| 4,571,872 | 2/1986 | Johnson | 224/913 |
| 4,691,852 | 9/1987 | Phelps | 224/913 |
| 4,819,844 | 4/1989 | Niemelä | 335/913 |
| 4,823,998 | 4/1989 | Johnson | 224/913 |
| 5,048,882 | 9/1991 | Fielding et al. | 16/114 A X |
| 5,075,996 | 12/1991 | Llames | 42/85 |

*Primary Examiner*—J. Casimer Jacyna
*Attorney, Agent, or Firm*—John R. Flanagan

[57] ABSTRACT

A fall-away gun sling attachment for a butt of a gun stock includes a hanger for connecting to a flexible sling and a connector attachable to a bottom of the gun stock butt for rotatably mounting the hanger to the bottom of the gun stock butt. The hanger includes a pair of laterally spaced elongated side members having upper and lower ends and an upper cross member extending between and rigidly interconnecting the upper ends of the side members. The connector defines a predetermined axis and is connected between the lower ends of the side members of the hanger so as to mount the hanger for rotational movement between an upper position in which the side members of the hanger extend along opposite sides of the gun stock butt and the upper cross member engages an upper rear end of the gun stock butt and a lower position in which the hanger and side members thereof are pivotally displaced below the gun stock butt. The connector includes a threaded anchoring portion for screwing into the bottom of the gun stock butt and a connecting portion having a pair of tubular elements attached to and extending along the predetermined axis oppositely from the anchoring portion. The tubular elements of the connecting portion rotatably connect with axle elements on the lower ends of the side members of the hanger so as to rotatably mount the hanger about the predetermined axis.

15 Claims, 1 Drawing Sheet

FALL-AWAY GUN SLING ATTACHMENT

BACKGROUND OF THE INVENTION

1. Field of the Invention

The present invention generally relates to a gun sling and, more particularly, is concerned with a fall-away gun sling attachment.

2. Description of the Prior Art

Slings have been employed with hand-carried firearms by both hunters and military personnel for many years. Such slings which can be placed over the users' shoulders typically extend between and interconnected with respective front and rear portions of the barrel and stock of the firearms. The main purpose of a sling is to support the weight of the firearm from a user's shoulder and thereby relieve the user from the burden of carrying the firearm (normally a rifle or shotgun) with his or her arm except during those periods of time in which it is anticipated that the firearm will be used or is actually being used.

Representative examples of the slings proposed in the prior patent art for this purpose are those disclosed in U.S. Pat. Nos. to Arpin (2,828,058 and 2,885,812), Moomaw (2,915,233), Gossler (3,182,871), Brokus (3,606,109), Johnson (4,555,051; 4,571,872; and 4,823,998), Phelps (4,691,852) and Niemela (4,819,844). For a sling serving this purpose to be satisfactory it meet certain performance requirements. First, the sling must allow the user to carry the firearm in a ready position in comfort from his or her shoulder, allowing the user to use his or her hands for other purposes while carrying the firearm in this position. Second, the sling must permit the user to quickly bring the firearm to a firing position without removing anything and without interference with the movement of the firearm to and placement at the firing position. While some of these prior art slings of the above-cited patents may minimally meet these performance requirements, most of them are either too complicated in their constructions to be practical or lack the structural sturdiness to be reliable after an extended period of use.

Consequently, it is perceived by the inventor of the present invention that a need still exists for a gun sling of suitable construction and function.

SUMMARY OF THE INVENTION

The present invention provides a fall-away gun sling attachment designed to meet the above-mentioned performance requirements and to satisfy the aforementioned need. Accordingly, the present invention is directed to a fall-away gun sling attachment for mounting to a butt of a gun stock. The sling attachment comprises: (a) a hanger including a pair of laterally spaced elongated side members having upper and lower ends and an upper cross member extending between and rigidly interconnecting the upper ends of the side members; and (b) a connector defining a predetermined axis and being coupled between the lower ends of the side members of the hanger. The connector is attachable to a bottom of the gun stock butt so as to mount the hanger to the bottom of the gun stock butt for pivotal movement about the predetermined axis between an upper position in which the side members of the hanger extend along opposite sides of the gun stock butt and the upper cross member engages an upper rear end of the gun stock butt and a lower position in which the hanger and side members and upper cross member thereof are pivotally displaced below the gun stock butt. The side members and upper cross member of the hanger define an overall inverted U-shaped configuration.

More particularly, the connector includes an anchoring portion having means for attaching to the bottom of the gun stock butt and a connecting portion having a pair of tubular elements attached to and extending along the predetermined axis oppositely from the anchoring portion. The tubular elements of the connecting portion rotatably mount the lower ends of the side members of the hanger about the predetermined axis.

The lower ends of the side members of the hanger include a pair of axle elements. The axle elements are spaced from one another and extend in a coaxial relation toward one another along the predetermined axis defined by the connector. The axle elements extend with and are rotatably mounted to the tubular elements of the connecting portion of the connector so as to pivotally mount the hanger for pivotal movement between the upper and lower positions relative to the gun stock butt about the predetermined axis. More particularly, the axle elements are formed by portions of the lower ends of the side members which are inturned so as to extend along the predetermined axis and in a transverse relation to the remainder of the extent of the side members.

The sling attachment also comprises a link member attached to the upper ends of the side members and extending above the upper cross member. The link member is shaped for connecting a flexible sling to the hanger. The link member extends relative to the side members so as to project inwardly over the upper rear end of the gun stock butt when the hanger is at the upper position and the upper cross member is engaged with the upper rear end of the gun stock butt. The side members of the hanger extend in a common plane and and the link member is bent forwardly into a plane extending at an acute angle relative to the common plane of the side members.

The side members of the hanger are relatively stiff but springy so as to be yieldably bendable from a normal contracted condition to an expanded condition in response to application opposing pulling forces at the lower ends of the side members. Upon release of the pulling forces, the side members automatically return to the contracted condition. The side members at the lower ends thereof are rotatably coupled with the connector when the side members are disposed at the contracted condition and permit pivotal movement of the hanger between upper and lower positions relative to the gun stock butt. The side members at the lower ends thereof are decoupled from the connector when side members are pulled to the expanded condition which permits either removing or installing of the hanger from and onto the connector.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figures 1, 2, 3, 4, 5, 6:
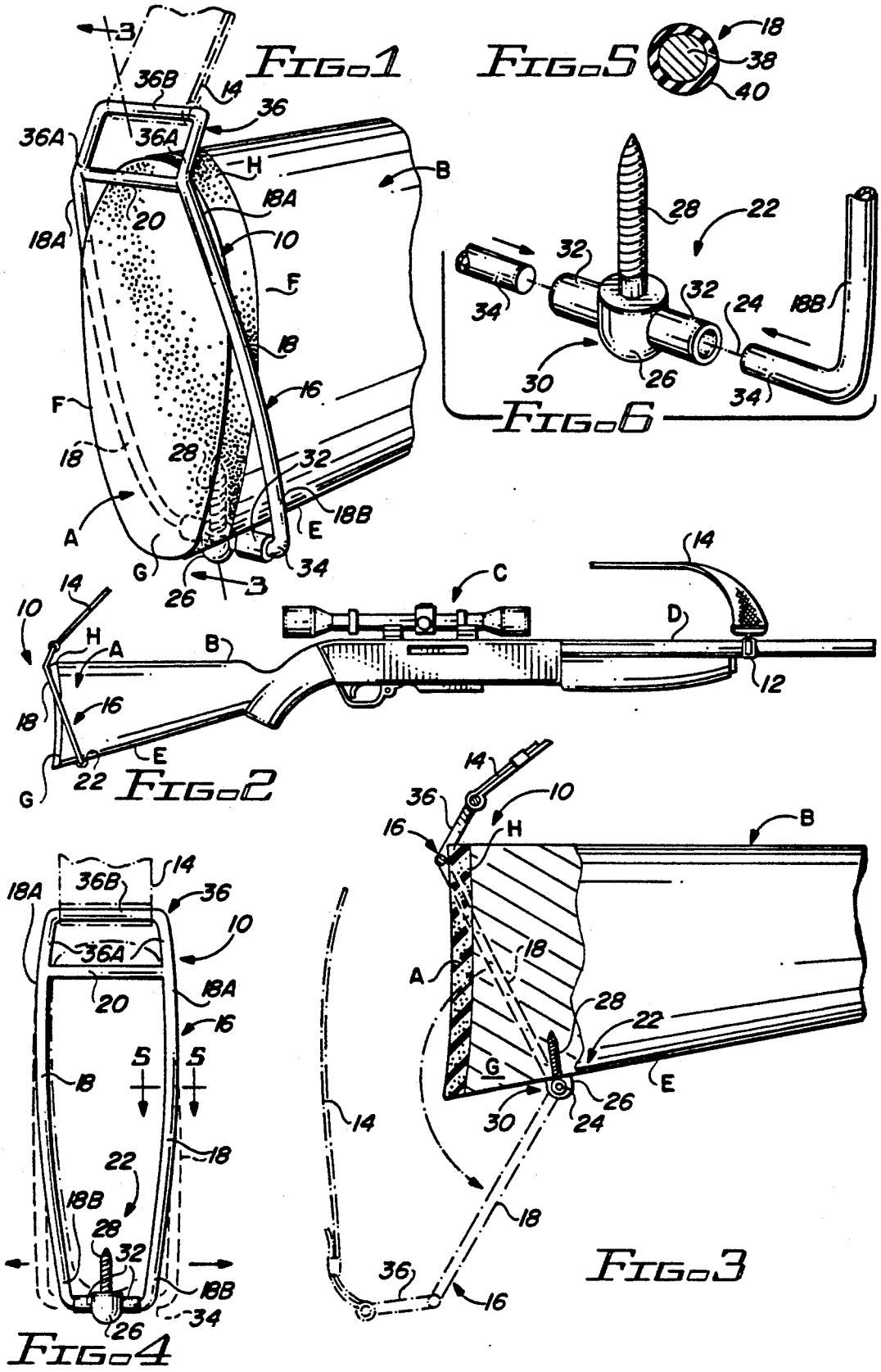
FIG. 1 is a rear perspective view of a butt of the stock of a gun with a fall-away gun sling attachment of the present invention installed thereon.
FIG. 2 is a side view, on a reduced scale, of a gun, incorporating the fall-away gun sling attachment of the present invention installed on the butt of the gun stock and assembled with an elongated flexible shoulder sling and a swivel mount attachment installed on the gun barrel.
FIG. 3 is a side elevational view, as seen along line 3—3 of FIG. 1, showing the butt of the gun stock, with portions broken away and sectioned, and a hanger of the fall-away gun sling attachment pivotally mounted to the gun stock butt being in an full-line upper position and a dashed-line lower position.
FIG. 4 is an end elevational view of gun stock butt and fall-away gun sling attachment of FIG. 1.
FIG. 5 is an enlarged cross-sectional view of one side leg portion of the hanger taken along line 5—5 of FIG. 4.
FIG. 6 is an enlarged perspective view of a bottom connector of the fall-away gun sling attachment and a pair of inwardly turned lower ends of the side leg portions of the hanger.

Referring to the drawings, and particularly to FIGS. 1 and 2, there is illustrated a fall-away gun sling attachment, generally designated 10, constructed in accordance with the principles of the present invention. The fall-away gun sling attachment 10 is adapted for mounting to a butt A of the stock B of a firearm C, such as any conventional civilian rifle or shotgun or military weapon. The sling attachment 10 is intended to be used in conjunction with any suitable prior art swivel band mount attachment 12 mounted to a barrel D of the firearm C and any -suitable prior art flexible sling 14 extended between and connected at opposite rear and front ends to the fall-away sling attachment 10 and the barrel mount attachment 12 for hanging over a shoulder of a user so as to support the firearm C in a substantially level position below the user's armpit under the shoulder.

Basically, the sling attachment 10 comprises a hanger 16 including a pair of laterally spaced elongated side members 18 having upper and lower ends 18A, 18B and an upper cross member 20 extending between and rigidly interconnecting the upper ends 18A of the side members 18, and a connector 22 defining a predetermined axis 24 and being coupled between the lower ends 18B of the side members 18 of the hanger 16. The connector 22 is adapted to be attached to a bottom E of the gun stock butt A so as to mount the hanger 16 to the bottom E of the gun stock butt A for pivotal movement about the predetermined axis 24 between an upper position, as shown in solid line form in FIGS. 1–4 and a lower position, as shown in dashed line form in FIG. 3.

As best seen in FIGS. 1 and 4, in the upper position the side members 18 of the hanger 16 extend in an inclined fashion rearwardly and upwardly along opposite sides F of the gun stock butt A, with a lower rear end portion G of the butt A extending between and projecting rearwardly of side members 18 and the upper cross member 10 engaging an upper rear end H of the gun stock butt A. On the other hand, as seen in FIG. 3, in the lower position the hanger 16 and thus the side members 18 and upper cross member 20 thereof are angularly displaced below the gun stock butt A. Overall, as seen in FIG. 4, the side members 18 and the upper cross member 20 of the hanger 16 form an inverted U-shaped configuration.

Referring to FIGS. 1, 3, 4 and 6, the connector 22 of the sling attachment 10 includes an anchoring portion 26 having means 28 for attaching to the bottom E of the gun stock butt A and a connecting portion 30 for coupling to the lower ends 18B of the side members 18 of the hanger 16. The anchoring portion 26 is in the form of an enlarged head 26 and the attaching means 28 is in the form of an externally-threaded screw 28 rigidly attached to the head 26. The connecting portion 30 includes a pair of tubular elements 32 rigidly attached to opposite sides of the head 26. The tubular elements 32 are hollow and extend along the predetermined axis 24 in opposite directions from the head 26. The tubular elements 32 rotatably mount the lower ends 18B of the side members 18 of the hanger about the predetermined axis 24.

Referring to FIGS. 1, 4 and 6, the lower ends 18B of the side members 18 of the hanger 16 include a pair of axle-like elements 34. The axle elements 34 are spaced from one another and extend in a coaxial relationship toward one another along the predetermined axis 24 defined by the connector 22. The axle elements 34 extend with and are rotatably mounted to the tubular elements 32 of the connector 22 so as to pivotally mount the hanger 16 for pivotal movement between the upper and lower positions relative to the gun stock butt A about the predetermined axis 24. The axle elements 34 are formed by integral portions of the lower ends 18B of the side members 18 which are permanently inturned so as to extend along the predetermined axis 24 and in a transverse relation to the remainder of the extent of the side members 18.

The sling attachment 10 also comprises a link member 36 having an inverted-U configuration. The link member 36 includes a pair of lower end portions 36A laterally spaced apart from one another and an upper middle portion 36B extending between and rigidly interconnecting the lower end portions 36A. The link member 36 is attached at its lower end portions 36A to the upper ends 18A of the side members 18. The link member 36 extends above the upper cross member 20 of the hanger 16. The shape of the link member 36 adapts it for connecting the rear end of the flexible sling 14 to the hanger 16. Also, as shown in FIGS. 1 and 3, the link member 36 extends relative to the side members 18 so as to project inwardly over the upper rear end of the gun stock butt when the hanger is at the upper position and the upper cross member is engaged with the upper rear end of the gun stock butt. The side members 18 and upper cross member 20 of the hanger 16 extend in a common plane and and the lower end portions 36A and upper middle portion 36B of the link member is bent forwardly into a plane extending at an acute angle, such as 40°–45° relative to the common plane of the side members 18 and upper cross member 20 of the hanger 16.

Referring to FIGS. 1, 4 and 6, the side members 18 of the hanger 16 are preferably constructed from a spring steel wire core 38 covered with a scratch-preventing rubber coating 40. Other suitable materials can be employed. The materials used should make the side members 18 relatively stiff but springy so as to be yieldably bendable from a normal contracted condition, as shown in full line form in FIG. 4, to an expanded condition, as shown in dashed line form in FIG. 4, in response to application of opposing pulling forces (in the directions of the arrows in FIG. 4) at the lower ends 18B of the side members 18. Upon release of the pulling forces, the material of the side members 18 cause them to return automatically to the contracted condition. The axle elements 34 on the lower ends 18B of the side members 18 of the hanger 16 are captured by and rotatably coupled with the tubular elements 32 of the connector 22 when the side members 18 are disposed at the contracted condition. On the other hand, the axle elements 34 on the lower ends 18B of the side members 18 of the hanger 16 are decoupled from the tubular elements 32 of the connector 22 when side members 18 of the hanger 16 are pulled to the expanded condition to faciliate either removing or installing of the hanger 16 from and onto the connector 22.

To install the sling attachment 10, a hole, for example 3/16 inch in depth, is drilled in the bottom of the stock butt A spaced, for example approximately 2 inches, from the rear edge of the butt A. Then, the connector 22 is tightly screwed into the hole. The side members 18 of the hanger 16 are pulled outwardly and held at their expanded condition so as to permit alignment of their axle elements 34 with the tubular elements 32 of the connector 22 and to facilitate snap fitting insertion of the axle elements 34 into the tubular elements 32. The upper cross member 20 should be located across the upper rear end H of the butt A spaced, for example approximately $\frac{3}{8}$ to $\frac{5}{8}$ inch, down from the top of the stock B when the hanger 16 is pivoted to its upper position.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A fall-away gun sling attachment for mounting to a butt of a gun stock, comprising:

(a) a hanger including a pair of laterally spaced elongated side members having upper and lower ends and an upper cross member extending between and rigidly interconnecting said upper ends of said side members;

(b) a connector defining a predetermined axis and being coupled between said lower ends of said side members of said hanger, said connector being attachable to a bottom of a butt of a gun stock so as to mount said hanger to the bottom of the gun stock butt for pivotal movement about said predetermined axis between an upper position in which said side members of said hanger extend along opposite sides of the gun stock butt and said upper cross member engages an upper rear end of the gun stock butt and a lower position in which hanger and said side members and upper cross member thereof are angularly displaced below the gun stock butt; and (c) a link member including a pair of lower end portions laterally spaced apart from one another and an upper middle portion extending between and rigidly interconnecting said lower end portions, said lower end portions of said link member being rigidly attached to said upper ends of said side members of said hanger, said upper middle portion of said link member being spaced above said upper cross member of said hanger and adapted for connection with a flexible sling wherein said side members and said upper cross member of said hanger extend in a common plane and said lower end portions and upper middle portion of said link member is bent forwardly into a plane extending at an acute angle relative to said common plain of said side members and upper cross member.

2. The sling attachment of claim 1 wherein said link member extends relative to said side members so as to project inwardly over the upper rear end of the gun stock butt when said hanger is at said upper position.

3. The sling attachment of claim 1 wherein said side members and said upper cross member of said hanger define an inverted U-shaped configuration.

4. A fall-away gun sling attachment for mounting to a butt of a gun stock, comprising:

(a) a hanger including a pair of laterally spaced elongated side members having upper and lower ends and an upper cross member extending between and rigidly interconnecting said upper ends of said side members; and (b) a connector defining a predetermined axis and being coupled between said lower ends of said side members of said hanger, said connector being attachable to a bottom of a butt of a gun stock so as to mount said hanger to the bottom of the gun stock butt for pivotal movement about said predetermined axis between an upper position in which said side members of said hanger extend along opposite sides of the gun stock butt and said upper cross member engages an upper rear end of the gun stock butt and a lower position in which hanger and said side members and upper cross member thereof are angularly displaced below the gun stock butt;

(c) said lower ends of said side members including a pair of axle elements being spaced from one another and extending in coaxial relation to one another along said predetermined axis defined by said connector and about which said hanger is pivotally moved between said upper and lower positions relative to the gun stock butt, said axle elements formed by portions of said lower ends of said side members being inturned so as to extend along said predetermined axis and in a transverse relation to the remainder of said side members;

(d) said connector including an anchoring portion having means for attaching to the gun stock butt and a connecting portion having a pair of tubular elements attached to and extending oppositely from said anchoring portion along said predetermined axis, said axle members on said side members being removably received in and rotatably mounted by said tubular elements of said connector.

5. A fall-away gun sling attachment for a butt of a gun stock, comprising:

(a) a connector attachable to a gun stock; and (b) a hanger including a pair of elongated laterally spaced side members having upper and lower ends and an upper cross member extending between and rigidly interconnecting said upper ends of said side members, said side members being relatively stiff but springy so as to be yieldably bendable from a normal contracted condition to an expanded condition in response to application opposing pulling forces at said lower ends of said side members and, upon release of the pulling forces, to return automatically to said contracted condition, said side members at said lower ends thereof being rotatably coupled with said connector when said side members are disposed at said contracted condition so as to permit pivotal movement of said hanger between upper and lower positions relative to the gun stock butt, said side members at said lower ends thereof being decoupled from said connector when said side members are pulled to said expanded condition so as to permit either removing or installing of said hanger from or onto said connector.

6. The sling attachment of claim 5 wherein said connector defines a predetermined axis and is attachable to a bottom of a butt of a gun stock so as to mount said hanger to the bottom of the gun stock butt for pivotal movement about said predetermined axis between said upper position in which said side members of said hanger extend along opposite sides of the gun stock butt and said upper cross member engages an upper rear end of the gun stock butt and said lower position in which hanger and said side members and upper cross member thereof are angularly displaced below the gun stock butt.

7. The sling attachment of claim 5 further comprising:

(c) a link member including a pair of lower end portions laterally spaced apart from one another and an upper middle portion extending between and rigidly interconnecting said lower end portions, said lower end portions of said link member being rigidly attached to said upper ends of said side members of said hanger, said upper middle portion of said link member being spaced above said upper cross member of said hanger and adapted for connection with a flexible sling.

8. The sling attachment of claim 7 wherein said link member extends relative to said side members so as to project inwardly over the upper rear end of the gun stock butt when said hanger is at said upper position.

9. The sling attachment of claim 7 wherein said side members and said upper cross member of said hanger extend in a common plane and said lower end portions and upper middle portion of said link member is bent forwardly into a plane extending at an acute angle relative to said common plane of said side members and upper cross member.

10. The sling attachment of claim 5 wherein said lower ends of said side members include a pair of axle elements being spaced from one another and extending in coaxial relation to one another along said predetermined axis defined by said connector and about which said hanger is pivotally moved between said upper and lower positions relative to the gun stock butt.

11. The sling attachment of claim 10 wherein said axle elements are formed by portions of said lower ends of said side members being inturned so as to extend along said predetermined axis and in a transverse relation to the remainder of said side members.

12. The sling attachment of claim 5 wherein said side members and said upper cross member of said hanger define an inverted U-shaped configuration.

13. The sling attachment of claim 5 wherein said connector includes:

an anchoring portion having means for attaching to the gun stock butt; and a connecting portion having a pair of tubular elements attached to and extending oppositely from said anchoring portion along said predetermined axis.

14. The sling attachment of claim 13 wherein said attaching means of said anchoring portion is a screw.

15. The sling attachment of claim 13 wherein said lower ends of said side members include a pair of axle elements being spaced from one another and extending in coaxial relation to one another along said predetermined axis, said axle elements being received in and rotatably mounted by said tubular elements of said connector.

* * * * *